United States Patent [19]

Bentley

[11] 4,398,870

[45] * Aug. 16, 1983

[54] VARIABLE VOLUME SONIC PRESSURE WAVE SURFACE OPERATED PUMP

[76] Inventor: Arthur P. Bentley, P.O. Box 1952, Roswell, N. Mex. 88201

[ * ] Notice: The portion of the term of this patent subsequent to Oct. 20, 1998, has been disclaimed.

[21] Appl. No.: 254,451

[22] Filed: Apr. 15, 1981

Related U.S. Application Data

[63] Continuation-in-part of Ser. No. 253,317, Apr. 13, 1981, which is a continuation-in-part of Ser. No. 160,934, Jun. 19, 1980, Pat. No. 4,341,505, which is a continuation-in-part of Ser. No. 958,552, Nov. 8, 1978, Pat. No. 4,259,799.

[51] Int. Cl.[3] ..... F04B 47/12

[52] U.S. Cl. ..... 417/240; 417/378

[58] Field of Search ..... 417/240, 241, 377, 378, 417/383; 92/13.7

[56] References Cited

U.S. PATENT DOCUMENTS

| | | | |
|---|---|---|---|
| 2,780,404 | 2/1957 | Kuehni | 92/13.7 |
| 2,910,875 | 11/1959 | Kuhnhausen | 92/13.7 X |
| 3,496,874 | 2/1970 | Findlay | 417/383 |
| 4,295,799 | 10/1981 | Bentley | 417/240 |

FOREIGN PATENT DOCUMENTS

| | | | |
|---|---|---|---|
| 1041371 | 10/1978 | Canada | 417/383 |

*Primary Examiner*—Leonard E. Smith

*Attorney, Agent, or Firm*—Herbert E. Haynes, Jr.

[57] ABSTRACT

A variable volume single tube surface operated pump including a piston reciprocally mounted in a cylinder for alternately opening and closing a liquid delivery port formed in the sidewall of the cylinder and for generating a sonic pressure wave by impacting a column of liquid in a metallic tube extending from the cylinder to a remote pumping mechanism located in communication with the liquid to be pumped. The piston is especially configured with a central recess in the face thereof so that the sonic pressure waves generated thereby will pass through a sonic inductor and move downwardly toward the pumping mechanism in a spiral-like motion against the inner wall of the metallic tube and enter into a sonic intensifier chamber where they are reflected off the pumping mechanism into a central column which travels back toward the cylinder and causes the liquid to be pumped to move in that same direction. A power operated drive mechanism is provided for reciprocally driving the piston and for adjustably varying the output volume of the liquid delivered by the pump.

24 Claims, 8 Drawing Figures

VARIABLE VOLUME SONIC PRESSURE WAVE SURFACE OPERATED PUMP

CROSS-REFERENCE TO RELATED APPLICATIONS

This application is a Continuation-in-Part of copending U.S. patent application Ser. No. 253,317, filed on Apr. 13, 1981, for SONIC PRESSURE WAVE SURFACE OPERATED PUMP, which is in turn a Continuation-in-Part of pending application Ser. No. 160,934, filed on June 19, 1980, now U.S. Pat. No. 4,341,505 for SONIC PRESSURE WAVE PUMP FOR LOW PRODUCTION WELLS, which is in turn a Continuation-in-Part of application Ser. No. 958,552, filed Nov. 8, 1978, for SONIC PRESSURE WAVE SURFACE OPERATED PUMP which issued as U.S. Pat. No. 4,259,799, on Oct. 20, 1981, all by the same inventor.

BACKGROUND OF THE INVENTION

1. Field of the Invention

This invention relates to pumps and more particularly to an improved sonic pressure wave surface operated pump.

2. Description of the Prior Art

It is well known to provide a pumping mechanism at an underground level to pump liquid from that level to the surface, with such a down hole pump being operated by a surface located mechanism which reciprocally impacts a column of liquid contained within a tube that communicates between the surface located mechanism and the down hole pump. The surface located mechanism, in addition to impacting the column of liquid, is reciprocally operated to alternately open and close a liquid delivery port. The impaction of the standing column of liquid produces hydraulic pressure waves that are transmitted by the liquid to the down hole pump to impart a reciprocal movement thereto. The down hole pump includes a plunger, or similar mechanism, which is biased upwardly by suitable springs, and has a central passage formed axially therethrough with a one-way check valve located in the lowermost end of the passage. When the hydraulic pressure waves move the plunger down against the spring bias, the check valve opens to admit the liquid being pumped into the passage, and the subsequent upstroke of the plunger closes the check valve and causes a general upward movement of the standing column of liquid with the uppermost portion thereof exiting through the liquid delivery port formed in the surface located mechanism.

Examples of the above described pumping mechanisms, and others which operate on that same basic principle, are fully disclosed in U.S. Pat. Nos.: 2,379,539; 2,355,618; 2,572,977; 2,751,848 and 3,277,831.

These prior art pumps critically depend upon ideal adjustment of the input frequency relative to the length of the tube in which the standing column of liquid is contained, that is, resonant timing. Further, such prior art pumps are seriously limited in their pumping capacities due to such factors as inertia of the liquid, and the like.

SUMMARY OF THE INVENTION

In accodance with the present invention, a variable volume sonic pressure wave surface operated single tube pump is disclosed as including a surface located sonic pressure wave generator from which a metallic tube depends so as to communicate with an underground, or down hole pumping mechanism that is located at the level of the liquid to be pumped.

The sonic pressure wave generator includes a cylinder having a liquid delivery port formed in the side thereof which is coupled to a remotely located liquid receiving reservoir. A piston of special configuration is mounted in the cylinder and is reciprocally operated therein for alternately opening and closing the liquid delivery port. Additionally, the reciprocal movement of the piston will cause it to impact a standing column of liquid carried in the metallic tube and extending into the cylinder to produce sonic pressure waves of special character. The liquid impacting face of the piston is formed with a centrally located truncated conical recess or cavity which extends axially into the piston with the inner end of that recess communicating with a blind cylindrical bore formed axially in the piston. Thus, the liquid impacting face of the piston is of ring-like configuration.

Impacting of the standing column of liquid by the piston configured as described above produces sonic pressure waves which pass through a sonic inductor means and move downwardly along the inner walls of the metallic tube in a spiral-like motion.

The underground, or down hole pumping mechanism, which is coupled to the lowermost end of the metallic tube is of generally cylindrical configuration having an axial bore formed therein. The uppermost end of the axial bore is especially configured to form a sonic intensifier chamber which receives the downwardly spiraling sonic pressure waves and causes an increase in the velocity thereof. A plunger is reciprocally mounted in the axial bore of the housing with that plunger having an axial passage formed therethrough with one-way check valve means located at the lowermost end of that passage. The plunger is biased upwardly by a compression spring which counterbalances the weight of the standing column of liquid. The downwardly spiraling sonic pressure waves, which are increased in velocity in the intensifier chamber, impinge upon the head of the plunger about its periphery thus forcing the plunger down which opens the check valve means and admits the liquid being pumped to the axial passage formed through the plunger. The impinging sonic pressure waves are reflected by the head of the plunger inwardly and upwardly into a column centrally of the metallic tube. This upwardly moving central column will carry the liquid being pumped with it.

Reciprocal driving of the special piston is accomplished by a suitable power means which produces a rotary motion that is converted into reciprocal motion within a drive/output volume adjustment means which is connected to reciprocally drive the piston. The drive-/output volume adjustment means is configured to allow the stroke of the piston to be adjusted so that the volume of the pumped liquid may be varied.

The pump of the present invention configured as described above, produces high pump output pressure and velocity, as compared with prior art pumps such as those hereinbefore described, with that output pressure and velocity being considerably higher than could be reasonably expected from a pump which operated upon hydraulic pressure alone. Exactly what takes place in the pump of the present invention is not clearly understood. It is known that the special configuration of the piston and the sonic inductor means located in the sonic generator produces sonic pressure waves of a special character and those waves, in conjunction with the sonic intensifier chamber in the down hole pumping mechanism, are responsible for the pump's performance. Exhaustive tests and experiments show that the generated sonic pressure waves move along the inner walls of the metallic tube in a spiral or threadlike motion and those downwardly spiraling waves do not appear to exert any downwardly applied pressure or other force on the liquid in the center of the tube. The downwardly spiraling pressure waves increase in velocity upon entering the sonic intensifier chamber and are reflected inwardly and upwardly as hereinbefore described. The upwardly moving central column of liquid is believed to be augmented with regard to pressure and velocity, by counteraction with the downwardly spiraling waves acting like a worm gear or lead screw to force the central column countercurrent to the generated pressure waves.

Accordingly, it is an object of the present invention to provide a new and useful pump.

Another object of the present invention is to provide a new and useful variable volume sonic pressure wave surface operated single tube pump.

Another object of the present invention is to provide a new and useful variable volume sonic pressure wave surface operated single tube pump having high pump output pressure and velocity as compared to known pumps.

Another object of the present invention is to provide a new and useful pump of the above described type which includes an aboveground sonic pressure wave generator which is coupled by a metallic tube to an underground pumping mechanism located at the level of the liquid to be pumped.

Another object of the present invention is to provide a new and useful pump of the above described type in which the aboveground sonic pressure wave generator includes a piston reciprocally operable in a cylinder for alternately opening and closing a liquid delivery port and for impacting a standing column of liquid contained within the metallic tube for generating sonic pressure waves which pass through a sonic inductor means and move downwardly along the inner walls of the tube in a spiral motion.

Another object of the present invention is to provide a new and useful pump of the above described characted in which the piston is reciprocally operated by a power means which is coupled to the piston by means for adjustably varying the stroke of the piston which allows varying of the volume of the liquid being delivered by the pump.

Another object of the present invention is to provide a new and useful pump of the above described character in which the piston operable in the sonic pressure wave generator has a truncated conical recess formed centrally in its liquid impacting face with that recess opening into a blind cylindrical bore formed axially in the piston.

Another object of the present invention is to provide a new and useful pump of the above described character in which the underground pumping mechanism is provided with a sonic intensifier chamber for receiving the sonic pressure waves from the metallic tube and increasing the velocity thereof.

Still another object of the present invention is to provide a new and useful pump of the above described character in which the underground pumping mechanism includes a plunger which is reciprocally operated by the sonic pressure waves to establish a pumping action, with the pressure waves impinging on the plunger and being reflected inwardly and upwardly therefrom to provide an upwardly moving central column of liquid in the metallic tube, with that central column of liquid carrying the liquid being pumped with it to the surface.

The foregoing objects of the present invention, as well as the invention itself, may be more fully understood from the following description when read in conjunction with the accompanying drawings.

DESCRIPTION OF THE PREFERRED EMBODIMENTS

Figure 1:
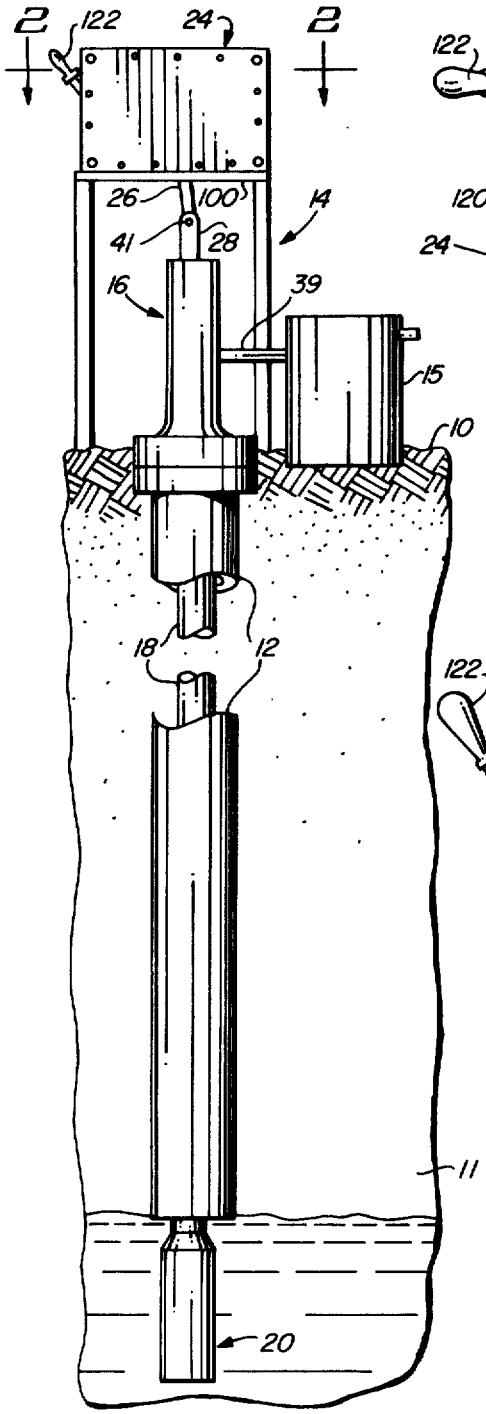
FIG. 1 is a section taken through a ground formation and illustrating the variable volume sonic pressure wave surface operated pump of the present invention within that ground formation.

Referring more particularly to the drawings, FIG. 1 illustrates a ground formation having a surface level 10 and an underground level 11 containing liquid which is to be pumped, such as water, oil and the like, and as is customary, particularly in the oil well art, the bore formed in the ground formation may be lined with a suitable casing 12. The variable volume sonic pressure wave surface operated pump of the present invention, which is indicated in its entirety by the reference numeral 14, is seen to be located in the ground formation in a conventional manner, and is suitably connected to a reservoir tank 15 for receiving the liquid pumped by the pump of the present invention.

Figure 2:
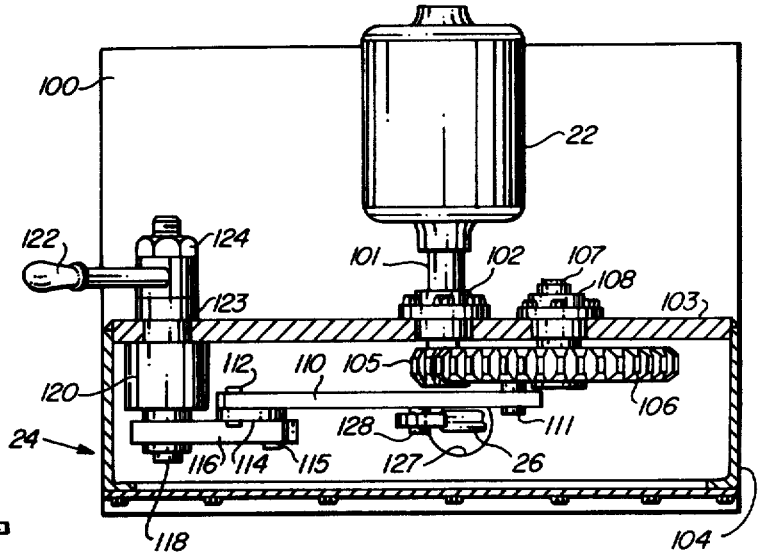
FIG. 2 is an enlarged sectional view taken on the line 2—2 of FIG. 1 and illustrating the drive/output volume adjustment means by which the pump's output volume may be adjustably varied.
Figure 3:
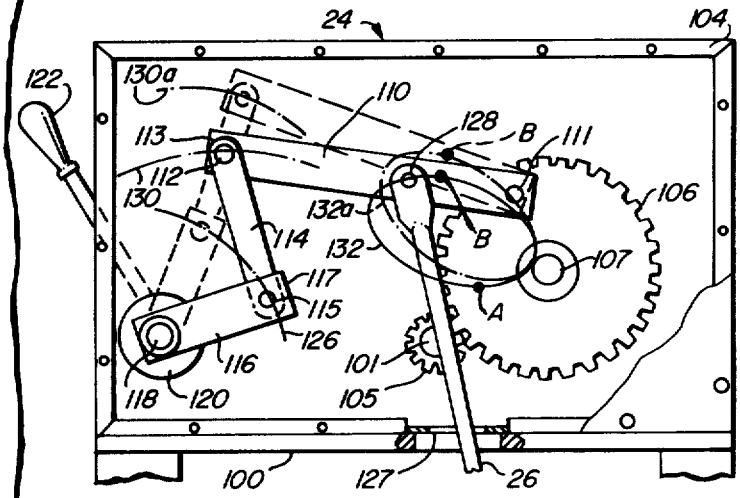
FIG. 3 is a front elevational view of the mechanism shown in FIG. 2 with portions thereof broken away to illustrate the various features thereof.

The variable volume sonic pressure wave surface operated pump 14, as will hereinafter be described in detail, includes an aboveground sonic pressure wave generator 16 from which a metallic tube 18 extends to an underground pumping mechanism 20 carried on the depending end of the metallic tube. As seen in FIGS. 2 and 3, a power input means 22, which may be any of several well known mechanisms, and is shown for illustrative purposes as an electric motor, is coupled through a drive/output volume adjustment means 24 to the sonic pressure wave generator 16 for operation thereof. In a manner which will hereinafter be described, the drive/output volume adjustment means 24 converts the rotary output of the power input means 22 into reciprocal motion which is connected by means of a crank arm 26 to a piston rod 28 for reciprocally driving the sonic pressure wave generator 16.

Figure 4:
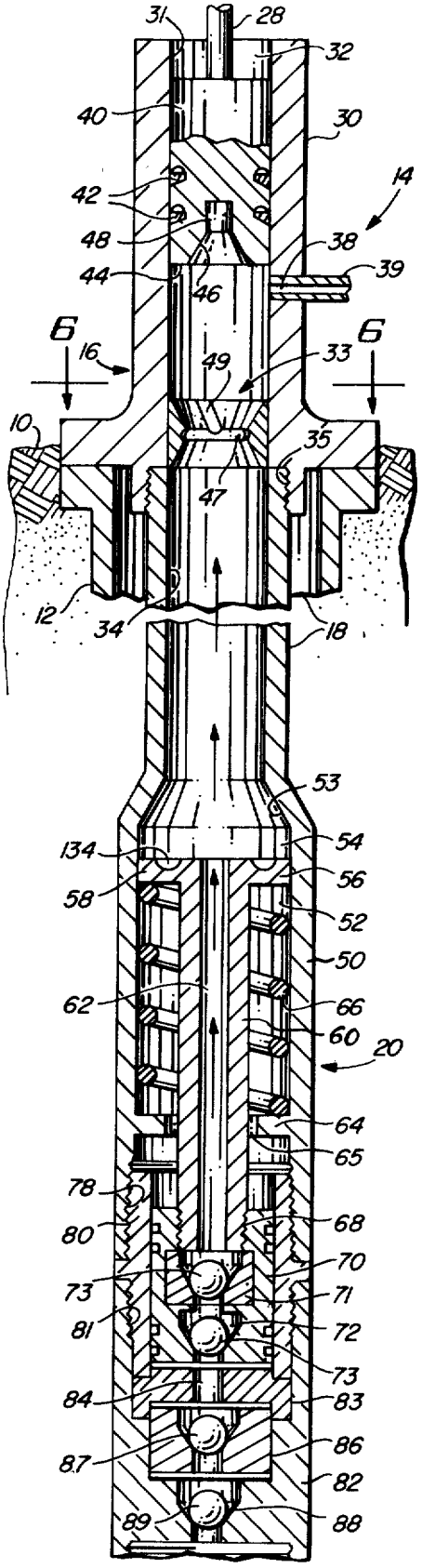
FIG. 4 is an enlarged fragmentary vertical section taken through the variable volume sonic pressure wave surface operated pump of the present invention and illustrating one operational position of that pump.
Figure 5:
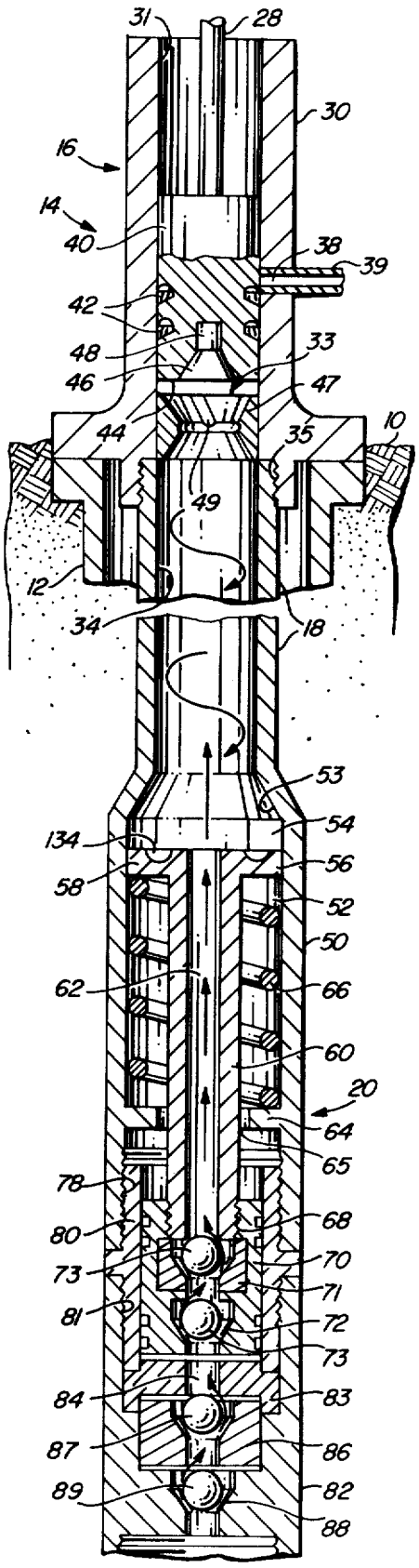
FIG. 5 is a view similar to FIG. 4 and showing the variable volume sonic pressure wave surface operated pump in a second operational position thereof.

Referring now to FIGS. 4 and 5, the sonic pressure wave generator 16 includes a vertically disposed cylinder 30 having an axial bore 31 formed therethrough, with that bore 31 having an open top 32 and a sonic inductor in the form of a sonic nozzle 33 adjacent its open bottom. The top 32 of the bore 31 is open to accommodate the piston rod 28, and the bottom is open so that it will communicate with the bore 34 formed through the metallic tube 18. The axial bore 31 of the vertical cylinder 30 is provided with internal threads 35 formed therein proximate the open bottom thereof which provides means for coupling the metallic tube 18 to the cylinder 30 in a manner which places the axial bore 31 of the cylinder 30 in communication with the bore 34 formed through the tube 18. The sonic nozzle 33 will hereinafter be described in detail.

The vertical cylinder 30 is also provided with a liquid delivery port 38 which extends laterally from the axial bore 31. A conduit 39 is connected to the outlet end of the port 38 and extends to the reservoir 15 for delivering pumped liquid thereto as will hereinafter become apparent as this description progresses.

The axial bore 31 provided in the cylinder 30 has an especially configured piston mounted therein, with the above mentioned piston rod 28 extending axially upwardly therefrom for connection to the crank arm by means of a suitable wrist pin 41 (FIG. 1) so that the piston 40 is reciprocal in the bore 31. The piston 40 is an elongated cylindrical structure having a plurality of annular labrynth grooves 42 which effectively prevent the upward escape of air and/or liquid from the cylinder 30. The lower, or fluid impacting end face 44 of the piston 40 has a truncated conical cavity or recess 46 formed axially therein with the upper end of that cavity being in communication with a blind cylindrical bore or socket 48 formed axially in the piston. Thus, the fluid impacting face 44 of the piston 40 is of ring-like configuration.

Figure 6:
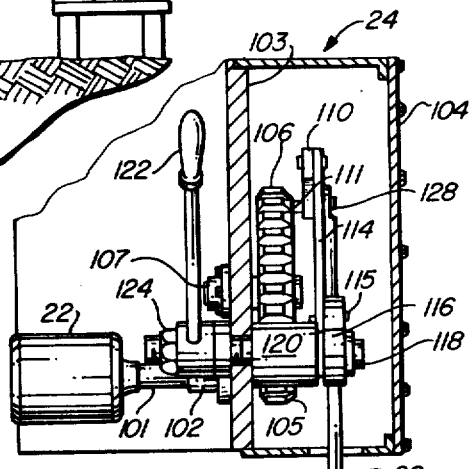
FIG. 6 is an enlarged fragmentary sectional view taken along the line 6—6 of FIG. 4.
Figure 6:
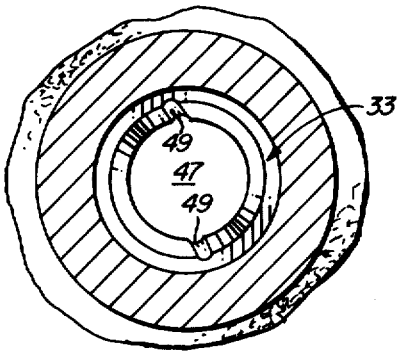

The sonic nozzle 33 is seen to be a plug-shaped member or body which is affixed, such as by welding, in the bore 31 of the cylinder 30 adjacent the open bottom thereof. The nozzle 33 is provided with a bore 47 which is coaxial with respect to the bore 31 of the cylinder 30 and the bore 34 of the metallic tube 18. The bore 47 of the nozzle 33 is configured with a first or upwardly disposed inverted frustro-conical surface and a second, or downwardly disposed frustro-conical surface. The upper conical surface is provided with a diametrically opposed pair of helical grooves 49 (FIG. 6) formed therein.

The metallic tube 18, which is connected to the bottom end of the sonic pressure wave generator 16, as hereinbefore described, contains a standing column (not shown) of the liquid being pumped. The downstroke of the piston 40 will cause the piston to impact the standing column of liquid which, due to the special configuration of the piston and the sonic nozzle will generate sonic pressure waves which move downwardly in a spiral-like path against the inner wall which define the bore 34 formed in the tube 18. It will be noted that the downstroke of the piston 40, as seen in FIG. 3, will close the lateral liquid delivery port 38 formed in the cylinder 30.

The underground, or down hole pumping mechanism 20, may be connected to the bottom end of the metallic tube 18 in any suitable manner with that connection being shown as the mechanism 20 being integral with the tube 18 for illustration purposes. In any case, the underground pumping mechanism 20 includes a housing 50 which is preferably of elongated cylindrical configuration due to the ease of lowering such a housing down through the casing 12. The housing 50 has an axial bore 52 formed therethrough, with that bore being of larger diameter than the bore 34 of the metallic tube 18, and is in axial communication therewith. The transition between the bores 34 and 52 is special in that the transition is accomplished by a truncated conical surface 53 which, in conjunction with the cylindrical area 54 immediately therebelow, defines a sonic intensifier chamber. The sonic intensifier chamber receives the downwardly spiraling sonic pressure waves as they emerge from the lower end of the metallic tube 18 and causes those waves to increase in velocity.

A plunger 56 is recpirocally mounted in the bore 52 of the housing 50, with that plunger having a head portion 58 at the upper end of a reduced diameter tubular body or stem 60. The plunger is axially disposed in the bore 52 and has an axial passage 62 formed therethrough so as to open upwardly onto the top surface of the head 58 centrally thereof and to open downwardly at the bottom end of the stem portion 60. The housing 50 is provided with an internal rib 64 which lies in a plane transverse to the longitudinal axis of the bore 52, and that rib has an opening 65 formed therethrough so as to be coaxial with the bore. A compression spring 66 is interposed between the downwardly facing surface of the head 58 and the upwardly facing surface of the rib 64. The spring 66 is specifically designed for each installation of the pump of the present invention so that the spring will substantially counterbalance the weight of the standing column of liquid in the metallic tube 18.

The lower end of the stem 60 of the plunger 56 extends through the opening 65 of the rib 64 and has external threads 68 formed thereon by which a check valve body 70 is threadingly attached. The body 70 has an axial bore formed therethrough with spacedly arranged vertically aligned valve seats 71 and 72 formed therein. A ball valve 73 is positioned in each of those valve seats, with those ball valves and their respective valve seats constituting a bleed valve assembly by which occluded air or other gas in the liquid being pumped is prevented from reaching the axial passage 62 of the plunger 56. In many instances, such a bleed valve assembly will not be an absolute requirement.

The lower end of the housing 50 is provided with internal threads 78 with the externally threaded upper end of a nipple 80 threadingly secured therein. The externally threaded lower end of the nipple 80 is threadingly attached to the internal threads 81 formed in the upper end of an end fitting 82. The end fitting 82 has a cylinder end wall 83 mounted in its bore immediately below the nipple 80, and that end wall 83 is formed with a central opening 84 which is in axial alignment with the bore of the check valve body 70. A valve seat ring 86 is positioned in the bore of the end fitting 82 below the end wall structure 83, and the valve seat ring 86 has a central passage in which is positioned a ball valve 87. The lowermost end of the fitting 82 is provided with a second valve seat 88 and a ball valve 89 with a central opening extending downwardly therefrom into communication with the liquid to be pumped from the underground level 11 (FIG. 1).

It will be noted that although two ball valves are shown for the air bleed function, and two ball valves are shown at the lowermost end of the down hole pumping mechanism, in many instances only one such ball valve will be necessary.

In addition to generating the sonic pressure waves which operate the pump 14 in the manner to hereinafter be described, it will be noted from the above that the special liquid impacting piston 40 accomplishes another function, namely that of closing the liquid delivery port 38 during the liquid impacting stroke of the piston and opening that port for delivery of the pumped liquid during the piston's return stroke. Therefore, the stroke of the piston at a given R.P.M. is a determining factor as to the volume of the liquid delivered by the pump in that the per cycle open time of the liquid delivery port 38 is affected by the length of the piston stroke.

As hereinbefore mentioned, the drive/output volume adjustment means 24 is employed to convert the rotary output of the power input means 22 into reciprocal movement which is employed to reciprocally drive the piston 40. And, in addition to this, the drive/output volume adjustment means 24 is configured in a manner which allows the stroke of the piston 40 to be easily changed for the purpose of providing the pump 14 with means for adjusting the pumped liquid output volume thereof as will now be described.

As seen in FIG. 1, the drive/output volume adjustment means 24 is supported on a suitable mounting platform 100 so as to be appropriately disposed with respect to the sonic pressure wave generator 16. As seen best in FIGS. 2 and 3, the power means 22 is also supported on the platform 100 and is disposed so that its output shaft 101 is journaled in a suitable bearing 102 carried in the side wall 103 of the housing 104 of the drive/output volume adjustment means 24. The output shaft 101 extends through the bearing 102 into the interior of the housing 104 and a pinion gear 105 is fixedly carried on the shaft for rotation therewith. The pinion gear 105 is in meshed engagement with a gear wheel 106 having a center shaft 107 which is journaled for rotation in a bearing 108 carried in the side wall 103 of the housing 104, for rotatably driving the gear wheel 106.

The above described gear arrangement is but one way of rotatably driving the wheel 106 in that the rotary output of the power means 22 can be accomplished in various well known manners such as by employing a chain-sprocket mechanism (not shown).

A connecting rod 110 has one of its ends connected excentrically on the rotatably driven wheel 106 by a suitable pivot pin 111 and has its opposite end connected by a similar pin 112 to the swing end 113 of an oscillating, or swing arm 114. The opposite end of the oscillating arm 114 is connected by a suitable pivot pin 115 to the extending end 117 of an anchor arm 116, the opposite end of which is fixedly carried on a shaft 118. The shaft 118 is rotatably carried in a bushing means 120 which is mounted fast on the inner surface of the side wall 103 of the housing 104. The shaft 118 extends through the side wall 103 of the housing 104 to provide an exteriorly extending end on which a suitable handle 122 is mounted. A spacer 123 is carried on the shaft 118 between the handle 122 and the exterior surface of the sidewall 103 and a jamb nut 124 is threadingly carried on the extending end of the shaft. With the jamb nut 124 in the threadingly loosened position, the handle 122 may be moved for rotation of the shaft about its axis with such rotation of the shaft causing the extending end 117 of the anchor arm 116 to be rotatingly moved in an arcuate path 126. When the jamb nut 124 is threadingly tightened it will exert a compression force to frictionally lock the shaft against rotation which fixedly positions the extending end 117 of the anchor arm 116 at any desired point along the arcuate path 126.

The crank arm 26, which passes through a hole 127 formed in the housing 104 and in the platform 100, as hereinbefore described has one of its ends connected to the piston rod 28, and its other end is seen to be connected by a suitable pivot pin 128 to the connecting rod 110 at a point between its opposite ends.

When the anchor arm 116 is locked in the position shown in solid lines in FIG. 3, and the wheel 106 is being rotatably driven in the above described manner, the swing end 113 of the oscillating arm 114 will be oscillated in an arcuate path 130 which results in the pivot pin 128 moving in an eliptical path shown in solid lines at 132. Such movement of the pivot pin 128 will cause the end of the crank arm 26 to move in that same eliptical path 132, and in so doing will reciprocally drive the piston 40 (FIGS. 4 and 5). In this solid line position, the stroke of the piston 40 is equal to the vertical distance between the point "A", which is the point on the eliptical path 132 which is closest to the piston 40, and the point "B" which is the point on the eliptical path 132 which is furthest from the piston 40.

By moving the anchor arm 116 from the solid line position to, for example, the position shown in dashed lines in the same figure, the oscillating arm 114 is moved so that its swing end 113 will oscillate in the arcuate path indicated at **130*a*. With the arcuate path 130*a* located as shown, the pivot pin 128 will now follow the eliptical path shown in dashed lines at 132*a*. It will be seen that when the eliptical path is moved from its solid line position 132 to its dashed line position 132*a*, the vertical distance between the points "A" and "B" will be substantially increased, and such an increase will produce a longer piston stroke and thus will increase the output volume of the liquid pumped by the pump 14**.

PUMP OPERATION

As hereinbefore mentioned, exactly what occurs in the variable volume sonic pressure wave surface operated pump of the present invention is not clearly understood. However, extensive testing and experimentation have shown the pump to produce much higher output pressure and velocity than could be reasonably expected from a pump operating on pure hydraulic principles. Those same tests and experiments lead me to believe that the pump operates in accordance with the following.

With the piston 40 of the aboveground sonic pressure wave generator 16 at the top of its upstroke as seen in FIG. 4, the lateral liquid delivery port 38 is open. When the piston 40 moves downwardly toward the bottom of its stroke, as shown in FIG. 5, the piston will close the liquid delivery port 38 and will impact the standing columm of liquid (not shown) that is contained in the lower portion of the axial bore 31 of the housing 30 and in the bore 34 of the metallic tube 18. Due to the special configuration of the piston 40, upon impacting the liquid column, it will generate a sonic pressure wave which spirals downwardly about the inner walls of the metallic tube 18 without exerting any downwardly exerted forces on the central core of the standing liquid column.

Although the function of the sonic nozzle is not clearly understood, it is thought that it enhances operation by accentuating the spiral motion of the sonic pressure waves and increasing the velocity thereof.

In initial testing of the pump, the nozzle was formed without the helical grooves 49, and the pump functioned quite well. However, an abrasive fluid was pumped through one testing sequence and very definite spiral or helical troughs were cut in the nozzle. After discovery of these troughs, the nozzle 33 was intentionally provide with the helical grooves 49 and this resulted in an improvement in the pumping capacity of the pump.

Upon reaching the lower end of the metallic tube 18, the downwardly spiraling sonic pressure waves emerge therefrom into the sonic intensifier chamber formed in the upper end of the down hole pumping unit 20, and will increase in velocity, and impinge upon the upper surface of the head portion 58 of the plunger 56. Such impingement will drive the plunger downwardly a sufficient amount to unseat the ball valves and admit the liquid being pumped into the axial passage 62 of the plunger. The impinging sonic pressure waves are reflected inwardly and upwardly to form an upwardly moving central column or core in the liquid within the metallic tube 18. This upwardly moving core will carry the liquid admitted to the passage 62 with it thus delivering the liquid to the aboveground sonic pressure wave generator 16 whereupon it will exit through the liquid delivery port 38. It is believed that the velocity and pressure of the upwardly moving central column of liquid is augmented by counteraction with the downwardly spiraling sonic pressure waves which act like a worm gear or lead screw that forces the central column countercurrent to the sonic pressure waves.

During the above mentioned initial testing of the pump, the top surface of the head 58 of the plunger 56 was flat, and the pump operated quite well. When the pump was disassembled during one of the routine inspections between tests, an endless groove was machined into the previously flat top surface, and subsequent tests showed improved pumping capacity without any apparent increase in power consumption.

It will be understood that the rate of rotation of the driven wheel 106 of the drive/output volume adjustment means 24, and thus the rate at which the piston 40 reciprocates, is related to the depth of a particular well, and the time it takes a sonic pressure wave to travel the length of the metallic tube 18. The rate of travel for the sonic pressure wave will also depend upon the particular liquid being pumped and the metal of which the tube 18 is made. By way of example, it will be noted that if the tube 18 has a length of approximately 2,500 feet and the sonic pressure wave will have a travel rate of approximately 5,000 feet per second, which has been found to be true of many, if not most of the materials under and through which the sonic pressure wave passes, it will take one-half of a second for the downwardly directed sonic pressure wave to engage the head 58 of the plunger 56, and another one-half second for its echo return, making a total time of one second per cycle of the piston 40. This means that the piston 40 would have to reciprocate 60 times per minute. Obviously, the rate of rotation of the driven wheel 106 which causes a cycle of piston reciprocation would vary with wells of different depth to accommodate the time required for a sonic pressure wave to travel downwardly and be reflected upwardly.

Figure 7:
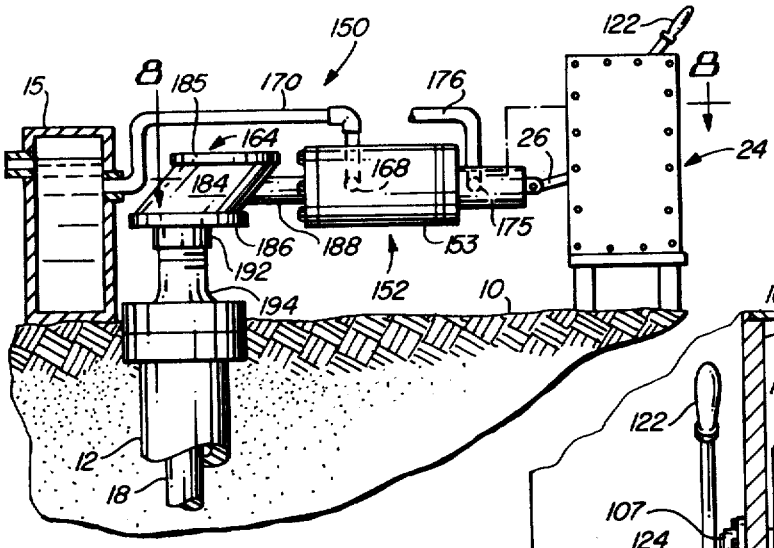
FIG. 7 is a fragmentary view similar to FIG. 1 and illustrating a second embodiment of the variable volume sonic pressure wave surface operated pump of the present invention.
Figure 8:
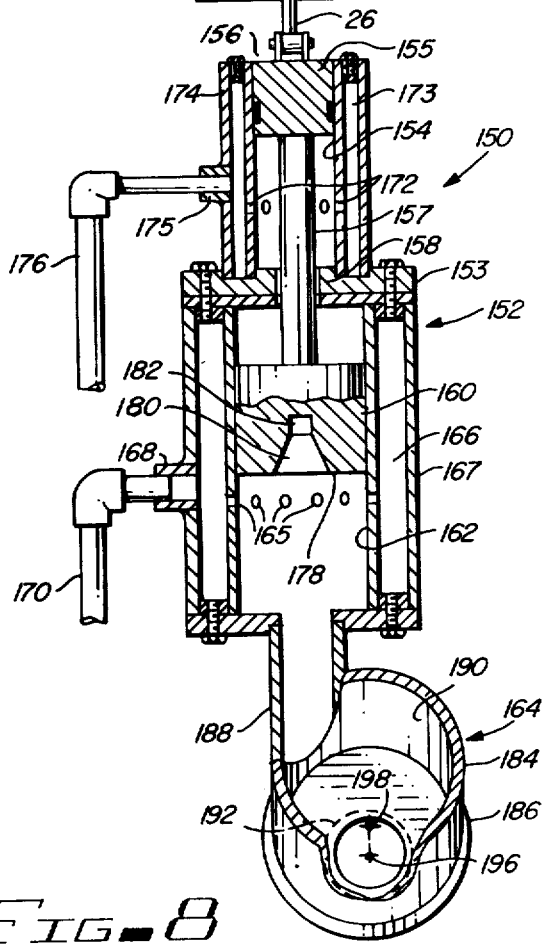
FIG. 8 is an enlarged fragmentary sectional view taken along the line 8—8 of FIG. 7.

Referring now to FIGS. 7 and 8 wherein a second embodiment of the variable volume sonic pressure wave surface operated pump is shown and is indicated in its entirity by the reference numeral 150.

The pump 150 differs from the previously described pump 14 in so far as its sonic pressure wave generator 152 is concerned, with the drive/output volume adjustment means 24, the metallic tube 18 and the downhole pumping mechanism 20 (FIGS. 4 and 5) being identical.

Since the sonic pressure wave generator 152 is the only part of the pump 150 which is different from that already described, the following description will be limited to that changed structure only.

Referring in particular to FIG. 8, the sonic pressure wave generator 152 is seen to include a generally cylindrical housing 153 having a first axial bore 152 in which a drive piston 155 is reciprocally mounted, with that bore having an open end 156 through which the crank arm 26 extends for connecting the drive piston 155 to the drive/output volume adjustment means 24 which has been turned on its side to suit this embodiment of the pump. A piston rod 157 extends axially from the drive piston 155 through a partition wall 158 and a fluid impacting piston 160 is mounted on the other end of the piston rod, with the fluid impacting piston 160 being reciprocally mounted in a second axial bore 162 formed axially in the cylindrical housing 153. The second axial bore 162 of the cylindrical housing is at least partially open on its other end so that the second axial bore 162 is in communication with the bore 34 of the metallic tube 18, (FIGS. 4 and 5) with this communication being accomplished through a swirl chamber 164 which forms a part of the sonic pressure wave generator, and which physically couples the sonic pressure wave generator 152 to the metallic tube 18 as will hereinafter be described.

The second axial bore 162 is provided with a circular array of apertures 165 formed through the sidewall thereof so that the bore 162 communicates with an annular collection chamber 166 formed by a jacket 167 so as to circumscribe the second bore 162. The circular array of apertures collectively form a fluid delivery port through which pumped fluid is delivered into the annular collection chamber 166 and is subsequently directed through an output port 168 provided on the jacket for delivery to the reservoir 15 via a conduit 170 as will become apparent as this description progresses.

The first axial bore 154 in which the drive piston 155 is reciprocally mounted, is similarly configured in that it is provided with a suitable array of apertures 172 formed through its sidewall which places the bore 154 in communication with an annular chamber 173 formed by a jacket 174, which is provided with an output port 175 having a conduit 176 connected thereto.

The fluid delivery port (apertures 165) and the collection chamber 166 provided for the second axial bore 162 is for the delivery of the pumped fluid as hereinbefore mentioned, and the apertures 172 and the annular chamber 173 of the first axial bore 154 are provided for leakage collection purposes. In other words, any fluid leaking from the second axial bore 162 into the first axial bore 154 will be collected and directed to a suitable disposal point.

The especially configured fluid impacting piston 160 includes a cylindrical body carried on the piston rod 157 which, as hereinbefore mentioned integrally connects the fluid impacting piston 160 and the drive piston 155 so that they are reciprocally movable in unison by the drive/output volume adjustment means 24. The fluid impacting face 178 of the special piston 160 has a truncated conical cavity, or recess 180 formed axially therein with the inner end of that cavity being in communication with a blind cylindrical bore or socket 182 formed axially in the piston. Thus, the fluid impacting face 178 of the piston 160 is of ring-like configuration, and operates in a manner identical to the previously described piston 40.

The swirl chamber 164 by which the sonic pressure wave generator 152 is coupled to the metallic tube 18 functionally replaces the sonic nozzle 53 of the pump 14 and includes a housing 184 which is configured in the shape of an oblique circular cylinder having a top plate 185 and a bottom plate 186 which lie in parallel planes and are fixedly attached to the housing such as by welding. A conduit 188 is attached to the housing 184 adjacent the top plate 185 and is tangentially disposed with respect to the housing, in other words, the axis of the conduit 188 is offset with respect to the axis of the housing 184 so that those axes do not intersect. The conduit 188 is connected to the cylindrical housing 153 so that the second axial bore 162 of the housing 153 is in communication with the bore 190 of the swirl chamber 164. Means in the preferred form of an internally threaded boss 192 is dependingly formed in the bottom plate 186 of the swirl chamber 164 and a coupling conduit 194 is connected to the boss so as to depend therefrom into mounted engagement with the downhole casing 12. The depending end of the coupling conduit 194 is configured for connection to the upper end of the metallic tube 18 so that the bore 190 of the swirl chamber 164 is in communication with the bore 34 of the metallic tube 18.

It will be noted that in some instances the coupling conduit 194 may be omitted and in such cases the upper end of the metallic tube 18 is threadingly attached directly to the depending boss 192 of the swirl chamber (not shown).

It has been found that the function of the swirl chamber 164, which is similar to that of the hereinbefore described sonic nozzle 33, is satisfactorily accomplished when the axis 196 of the internally threaded depending boss means 192 passes through the center 198 of the bottom plate 186 so that those components are coaxial. However, functioning of the swirl chamber 164 is improved when the axis 196 of the boss 192 is offset from the center 198 of the bottom plate 186 in a direction away from the side of the housing 184 to which the conduit 188 is coupled, as shown in FIG. 8.

As was the case in the hereinbefore described pump 14, exactly what occurs in the pump 150 is not clearly understood, but enough is known to establish that the sonic pressure wave generator 152 works in essentially the same manner as the generator 16, and thus the operational description will not be repeated.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A variable volume sonic pressure wave surface operated single tube pump for pumping liquid from an underground level to a ground surface comprising:

(a) a sonic pressure wave generator including,

I. a cylinder housing having a bore for containing liquid in one end portion thereof and having a liquid delivery port means extending laterally from that bore, II. a liquid impacting piston reciprocal in the bore of said cylinder housing for opening and closing the liquid delivery port means thereof and for reciprocally impacting the liquid containable therein, III. said liquid impacting piston having a liquid impacting end face with a central recess formed therein which generates a sonic pressure wave upon impacting the liquid containable in the bore of said cylinder housing, IV. a sonic inductor in the form of a sonic nozzle having a bore for containing liquid located in the one end portion of the bore of said cylinder housing so that the bore of said sonic nozzle is coaxial with the bore of said cylinder housing;

(b) a metallic tube having a bore for containing liquid and having one end which is in communication with the bore of said nozzle so that the sonic pressure waves generatable in said cylinder housing will pass through said sonic nozzle and be received and transmitted in the bore of said metallic tube;

(c) pumping mechanism means connected to the other end of said metallic tube and in communication with the liquid to be pumped, said pumping mechanism means including a reciprocally operable plunger for impingingly receiving the sonic pressure waves when transmitted by said metallic tube and reflecting those waves into a centrally and upwardly moving column which carries the liquid being pumped in the same direction;

(d) power input means; and (e) drive/output volume adjustment means connected to receive power from said power input means and coupled to said liquid impacting piston for reciprocal driving thereof, said drive/output volume adjustment means including means for adjustably varying the stroke of said liquid impacting piston for adjusting the output volume of the liquid being pumped.

2. A variable volume sonic pressure wave surface operated single tube pump as claimed in claim 1 wherein said sonic nozzle comprises:

(a) a plug-shaped body having an axial bore formed therethrough;

(b) said body having a first frustro-conical surface which faces toward said liquid impacting piston and a second frustro-conical surface which is inverted with respect to said first frustro-conical surface and which cooperatively form the axial bore through said body; and (c) said body having a diametrically opposed pair of helical grooves formed in the first frustro-conical surface thereof.

3. A variable volume sonic pressure wave surface operated single tube pump as claimed in claim 1 and further comprising a liquid reservoir at the ground surface for containing liquid the same as the liquid to be pumped, said reservoir connected to the liquid delivery port means of said cylinder housing.

4. A variable volume sonic pressure wave surface operated single tube pump as claimed in claim 1 wherein the central recess formed in the liquid impacting end face of said liquid impacting piston is of truncated conical configuration.

5. A variable volume sonic pressure wave surface operated single tube pump as claimed in claim 1 wherein the central recess formed in the liquid impacting end face of said liquid impacting piston is of truncated conical configuration which communicates with a blind cylindrical bore formed axially in said liquid impacting piston.

6. A variable volume sonic pressure wave surface operated single tube pump as claimed in claim 1 wherein the liquid impacting end face of said liquid impacting piston is of ring-like configuration with the central recess thereof being of truncated conical configuration which communicates with a blind cylindrical bore formed axially in said liquid impacting piston.

7. A variable volume sonic pressure wave surface operated pump as claimed in claim 1 wherein said drive-/output volume adjustment means comprises:

(a) a wheel;

(b) means connected between said power input means and said wheel for rotational driving thereof;

(c) linkage means eccentrically connected to said wheel and having a point thereon which moves in an eliptical path when said wheel is rotatably driven;

(d) a crank arm having one end connected to the point of said linkage means for movement in the eliptical path thereof, said crank arm having its other end coupled to said liquid impacting piston for reciprocal driving thereof; and (e) said linkage means being adjustable for changing the location of the eliptical movement path of the point thereof for adjustably varying the reciprocal stroke of said crank arm.

8. A variable volume sonic pressure wave surface operated pump as claimed in claim 1 wherein said drive-/output volume adjustment means comprises:

(a) a wheel;

(b) means connected between said power input means and said wheel for rotational driving thereof;

(c) a connecting rod having one end connected eccentrically and pivotably to said wheel;

(d) an oscillating arm having a swing end reciprocally movable in an arcuate path with the swing end pivotably connected to the other end of said connecting rod;

(e) a crank arm having one end pivotably connected to said connecting rod at a point between the ends thereof for following an eliptical path when said wheel is rotatably driven, the other end of said crank arm being coupled to said liquid impacting piston for reciprocal driving thereof; and (f) adjustable anchor means pivotably connected to the other end of said oscillating arm for adjustably fixing that other end at various locations to adjustably establish the location of the arcuate path of the swing end of said oscillating arm and thereby adjustably establish the location of the eliptical movement path of the one end of said crank arm.

9. A variable volume sonic pressure wave surface operated pump as claimed in claim 8 wherein said adjustable anchor means comprises:

(a) a rotatable shaft;

(b) an anchor arm connected to said shaft for rotation therewith and having an extending end which is pivotably connected to the other end of said oscillating arm;

(c) a handle mounted on said shaft by which said shaft is rotatable; and (d) means for selectively locking said shaft against rotation.

10. A variable volume sonic pressure wave surface operated single tube pump as claimed in claim 1 wherein said pumping mechanism means comprises:

(a) a housing having a bore for containing liquid and which communicates with the bore of said metallic tube for receiving the sonic pressure waves upon transmission thereof by said metallic tube, said housing having a lower end wall with a passage formed therethrough which communicates with the liquid to be pumped;

(b) said bore of said housing being of larger diameter than the bore of said metallic tube and configured at its upper end to form a sonic intensifier chamber for increasing the velocity of the sonic pressure waves upon receipt thereof;

(c) a one-way check valve in the passage formed in the end wall of said housing;

(d) said plunger is reciprocally mounted in the bore of said housing and has a head from which a reduced diameter stem depends, said plunger having a passage formed axially therethrough;

(e) biasing means in the bore of said housing and bearing against said plunger to bias said plunger upwardly so as to counterbalance the weight of the liquid containable in said metallic tube, in said sonic inductor and in the one end portion of said cylinder housing; and (f) said plunger having a substantially flat upper surface for reflecting the sonic pressure waves which impinge thereon.

11. A variable volume sonic pressure wave surface operated single tube pump as claimed in claim 10 wherein the sonic intensifier chamber formed at the upper end of said housing comprises a truncated conical surface which forms the transition between the bore of said metallic tube and the bore of said housing.

12. A variable volume sonic pressure wave surface operated single tube pump as claimed in claim 10 wherein the substantially flat upper surface of said plunger is provided with an endless groove formed therein.

13. A variable volume sonic pressure wave surface operated single tube pump for pumping liquid from an underground level to a ground surface comprising:

(a) a sonic pressure wave generator including,

I. a cylinder housing having a bore for containing liquid in one end portion thereof and having a liquid delivery port means extending laterally from that bore, II. a liquid impacting piston reciprocal in the bore of said cylinder housing for opening and closing the liquid delivery port means thereof and for reciprocally impacting the liquid containable therein, III. said liquid impacting piston having a liquid impacting end face with a central recess formed therein which generates a sonic pressure wave upon impacting the liquid containable in the bore of said cylinder housing;

(b) a sonic pressure wave swirl chamber including,

I. a housing of oblique circular cylindrical configuration having a closed top end and a closed bottom end and defining a bore for containing liquid, II. conduit means connected between said oblique circular cylindrical housing and said cylinder housing to place the bore of said oblique circular cylindrical housing in communication with the one end of the bore of said cylinder housing, said conduit means being disposed adjacent said closed top end and tangential with respect to said oblique circular cylindrical housing, III. coupling means in the closed bottom end of said oblique circular cylindrical housing;

(c) a metallic tube having a bore for containing liquid and having one end connected to said coupling means of said sonic pressure wave swirl chamber so that the sonic pressure waves generatable in said cylinder housing will pass through said sonic pressure wave swirl chamber and be received and transmitted in the bore of said metallic tube;

(d) pumping mechanism means connected to the other end of said metallic tube and in communication with the liquid to be pumped, said pumping mechanism means including a reciprocally operable plunger for impingingly receiving the sonic pressure waves when transmitted by said metallic tube and reflecting those waves into a centrally and upwardly moving column which carries the liquid being pumped in the same direction;

(e) power input means; and (f) drive/output volume adjustment means connected to receive power from said power input means and coupled to said liquid impacting piston for reciprocal driving thereof, said drive/output volume adjustment means including means for adjustably varying the stroke of said liquid impacting piston for adjusting the output volume of the liquid being pumped.

14. A variable volume sonic pressure wave surface operated single tube pump as claimed in claim 13 wherein said coupling means formed in the closed bottom of said oblique circular cylindrical housing is offset with respect to the center of said closed bottom end in a direction which is opposite to that of the tangential connection of said conduit means to said oblique circular cylindrical housing.

15. A variable volume sonic pressure wave surface operated single tube pump as claimed in claim 13 and further comprising a liquid reservoir at the ground surface for containing liquid the same as the liquid to be pumped, said reservoir connected to the liquid delivery port means of said cylinder housing.

16. A variable volume sonic pressure wave surface operated single tube pump as claimed in claim 13 wherein the central recess formed in the liquid impacting end face of said liquid impacting piston is of truncated conical configuration.

17. A variable volume sonic pressure wave surface operated single tube pump as claimed in claim 13 wherein the central recess formed in the liquid impacting end face of said liquid impacting piston is of truncated conical configuration which communicates with a blind cylindrical bore formed axially in said liquid impacting piston.

18. A variable volume sonic pressure wave surface operated single tube pump as claimed in claim 13 wherein the liquid impacting end face of said liquid impacting piston is of ring-like configuration with the central recess thereof being of truncated conical configuration which communicates with a blind cylindrical bore formed axially in said liquid impacting piston.

19. A variable volume sonic pressure wave surface operated single tube pump as claimed in claim 13 wherein said drive/output volume adjustment means comprises:

(a) a wheel;

(b) means connected between said power input means and said wheel for rotational driving thereof;

(c) linkage means eccentrically connected to said wheel and having a point thereon which moves in an eliptical path when said wheel is rotatably driven;

(d) a crank arm having one end connected to the point of said linkage means for movement in the eliptical path thereof, said crank arm having its other end coupled to said liquid impacting piston for reciprocal driving thereof; and (e) said linkage means being adjustable for changing the location of the eliptical movement path of the point thereof for adjustably varying the reciprocal stroke of said crank arm.

20. A variable volume sonic pressure wave surface operated pump as claimed in claim 13 wherein said drive/output volume adjustment means comprises:

(a) a wheel;

(b) means connected between said power input means and said wheel for rotational driving thereof;

(c) a connecting rod having one end connected eccentrically and pivotably to said wheel;

(d) an oscillating arm having a swing end reciprocally movable in an arcuate path with the swing end pivotably connected to the other end of said connecting rod;

(e) a crank arm having one end pivotably connected to said connecting rod at a point between the ends thereof for following an eliptical path when said wheel is rotatably driven, the other end of said crank arm being coupled to said liquid impacting piston for reciprocal driving thereof; and (f) adjustable anchor means pivotably connected to the other end of said oscillating arm for adjustably fixing that other end at various locations to adjustably establish the location of the arcuate path of the swing end of said oscillating arm and thereby adjustably establish the location of the eliptical movement path of the one end of said crank arm.

21. A variable volume sonic pressure wave surface operated pump as claimed in claim 20 wherein said adjustable anchor means comprises:

(a) a rotatable shaft;

(b) an anchor arm connected to said shaft for rotation therewith and having an extending end which is pivotably connected to the other end of said oscillating arm;

(c) a handle mounted on said shaft by which said shaft is rotatable; and (d) means for selectively locking said shaft against rotation.

22. A variable volume sonic pressure wave surface operated single tube pump as claimed in claim 13 wherein said pumping mechanism means comprises:

(a) a housing having a bore for containing liquid and which communicates with the bore of said metallic tube for receiving the sonic pressure waves upon transmission thereof by said metallic tube, said housing having a lower end wall with a passage formed therethrough which communicates with the liquid to be pumped;

(b) said bore of said housing being of larger diameter than the bore of said metallic tube and configured at its lower end to form a sonic intensifier chamber for increasing the velocity of the sonic pressure waves upon receipt thereof;

(c) a one-way check valve in the passage formed in the end wall of said housing;

(d) said plunger is reciprocally mounted in the bore of said housing and has a head from which a reduced diameter stem depends, said plunger having a passage formed axially therethrough;

(e) biasing means in the bore of said housing and bearing against said plunger to bias said plunger upwardly so as to counterbalance the weight of the liquid containable in said metallic tube, in said sonic pressure wave swirl chamber and in the one end portion of said cylinder housing; and (f) said plunger having a substantially flat upper surface for reflecting the sonic pressure waves which impinge thereon.

23. A variable volume sonic pressure wave surface operated single tube pump as claimed in claim 22 wherein the sonic intensifier chamber formed at the upper end of said housing comprises a truncated conical surface which forms the transition between the bore of said metallic tube and the bore of said housing.

24. A variable volume sonic pressure wave surface operated single tube pump as claimed in claim 22 wherein the substantially flat upper surface of said plunger is provided with an endless groove formed therein.

* * * * *